US007799189B2

(12) United States Patent
Barclay et al.

(10) Patent No.: US 7,799,189 B2
(45) Date of Patent: Sep. 21, 2010

(54) CLOSED END SLOTTED CARBON ANODES FOR ALUMINUM ELECTROLYSIS CELLS

(75) Inventors: Ron D. Barclay, Summerville, SC (US); Gary P. Tarcy, Murrysville, PA (US); Robert B. Hosler, Sarver, PA (US); Xiangwen Wang, Export, PA (US); Jay N. Bruggeman, Harrison City, PA (US)

(73) Assignee: Alcoa Inc., Pittsburgh, PA (US)

( * ) Notice: Subject to any disclaimer, the term of this patent is extended or adjusted under 35 U.S.C. 154(b) by 526 days.

(21) Appl. No.: 11/671,392

(22) Filed: Feb. 5, 2007

(65) Prior Publication Data

US 2007/0125643 A1 Jun. 7, 2007

Related U.S. Application Data

(63) Continuation-in-part of application No. 10/799,036, filed on Mar. 11, 2004, now Pat. No. 7,179,353.

(51) Int. Cl.
*C25B 11/02* (2006.01)

(52) U.S. Cl. ..... 204/294; 204/246; 204/243.1; 204/245; 204/280

(58) Field of Classification Search ..... 204/246, 204/243.1, 245, 280, 294
See application file for complete search history.

(56) References Cited

U.S. PATENT DOCUMENTS

| | | | | |
|---|---|---|---|---|
| 2,480,474 | A | 8/1949 | Johnson | 204/67 |
| 3,822,195 | A | 7/1974 | Dell et al. | 204/64 |
| 4,707,239 | A | 11/1987 | Murphy et al. | 204/247 |
| 5,330,631 | A | 7/1994 | Juric et al. | 204/243 |
| 5,683,559 | A | 11/1997 | de Nora | 204/243 |
| 6,146,506 | A | 11/2000 | Bauer et al. | 204/247 |
| 6,800,191 | B2 | 10/2004 | Barnett et al. | 205/380 |
| 7,179,353 | B2 * | 2/2007 | Barclay et al. | 204/246 |

OTHER PUBLICATIONS

How to Obtain Open Feeder Holes by Installing Anodes with Tracks; Light Metals 1998 Bjorn Petter Moxnes, Bjorn Erik Aga and Jorn Hembre Skarr; pp. 247-255.

Office Action from related U.S. Appl. No. 11/671,386, mailed Dec. 22, 2009.

* cited by examiner

*Primary Examiner*—Bruce F Bell
(74) *Attorney, Agent, or Firm*—Greenberg Traurig, LLP

(57) ABSTRACT

An electrolysis cell (10) contains a number of carbon anodes (12) having top, bottom and side surfaces, operating in molten electrolyte (17) in an aluminum electrolysis cell (10), where gas bubbles (28) are generated at the anode surfaces and where alumina particles (20) are added to the top of the molten electrolyte, where the carbon anodes (12) have one inward slot (21) passing through the carbon anode (12) along the longitudinal axis 40 of the carbon anode and also passing through only one front surface (25) of the carbon anode, where the height (32) of the slot (21) is from about 45% to 80% of the anodes thickness and the slotted front surfaces (25) are disposed toward the center of the electrolysis cell so that generated gas bubbles (28) are directed to the alumina particles.

12 Claims, 2 Drawing Sheets

CLOSED END SLOTTED CARBON ANODES FOR ALUMINUM ELECTROLYSIS CELLS

CROSS-REFERENCE TO RELATED APPLICATION(S)

This application is a continuation-in-part of U.S. patent application Ser. No. 10/799,036 filed Mar. 11, 2004, entitled "Closed End Slotted Carbon Anodes for Aluminum Electrolysis Cells", now U.S. Pat. No. 7,179,353, which is incorporated herein by reference in its entirety.

FIELD OF THE INVENTION

The present invention relates to improved slotted carbon anodes for use in aluminum electrolysis cells.

BACKGROUND OF THE INVENTION

Aluminum is produced conventionally by the electrolysis of alumina dissolved in cryolite-based (usually as NaF plus $AlF_3$) molten electrolytes at temperatures between about 900° C. and 1000° C.; the process is known as the Hall-Heroult process. A Hall-Heroult reduction cell/"pot" typically comprises a steel shell having an insulating lining of refractory material, which in turn has a lining of carbon that contacts the molten constituents. Conductor bars connected to the negative pole of a direct current source are embedded in the carbon cathode substrate that forms the cell bottom floor. The carbon lining and cathode substrate have a useful life of three to eight years, or even less under adverse conditions. In general carbon anodes are consumed with evolution of carbon oxide gas, as bubbles and the like.

The consumption of carbon anodes in molten electrolyte is shown in FIG. 6a of U.S. Pat. No. 2,480,474 (Johnson). Anodes are at least partially submerged in the bath and those anodes as well as their support structures are replaced regularly once consumed. Alumina is fed into the bath during cell operation and it is important to have good alumina dissolution. The anode gas bubbles can be used to create a turbulence in the alumina feeding zone to reduce alumina agglomeration. It is important to create a good turbulence by anode gas bubbles to the extent favorable to increase alumina dissolution.

Traditional technology relied on natural flow of gases from under the carbon anodes curing the aluminum reduction process, but this delayed gas bubble removal and decreased efficiencies and aluminum production.

This presence and build up of gas generated during electrolysis has been a continuing problem in the industry and a cause of high energy requirements, and to efficiently operate the electrolysis cells, the electrodes must be properly designed. Dell et al., in U.S. Pat. No. 3,822,195, taught bipolar anodes having channels (nine shown in FIG. 2) on their bottom between a downward gas dam along three sides of the anode marginal ledge communicating with a lateral connecting channel. This patent relates to the production of aluminum electrolytically from a metal chloride dissolved in molten solvent. The described design does not apply to the Hall cell process since the anodes in the chloride system are non-consumable.

Use of single and multiple bottom anode tracks, across the entire anode bottom, to improve gas release in aluminum processing has also been reported in Light Metals, "How to Obtain Open Feeder Holes by Installing Anodes with Tracks" B. P. Moxnes et al., Edited by B. Welch, The Minerals, Metals & Materials Society, 1998, pp 247-255. There for a 141 cm anode, a track width of 2 cm was suggested, as tracks less than 1 cm did not drain gas properly, while the maximum height suggested was 16 cm.

U.S. Pat. No. 5,330,631 (Juric et al.) relates to an aluminum smelting cell and describes anodes with downwardly extending peaks, V shaped profiles and angularly positioned inward protrusions each having three sides to achieve desired electrolyte bath flow and controlled bubble release. Somewhat similarly, de Nora in U.S. Pat. No. 5,683,559 teaches grooves in cathodes said to improve gas circulation, as well as outwardly sloped V shaped anodes for electro winning of aluminum.

All of the designs pose a number of problems. Natural flow decreases efficiencies, continuous slots disrupt the metal bath interface between the anode and cell sidewall causing loss of current efficiency, and a large number of slots causes problems of extensive machining and loss of carbon.

What is needed is a carbon anode design that facilitates gas bubble movement rapidly to the centerline of the reduction cell to expedite dissolution of alumina, including alumina fines that typically float on top of the bath and are slow to dissolve. At the same time, the carbon anode design should allow the pots to operate at a lower pot noise and reduced pot voltage and therefore lower power consumption and higher current efficiency.

It is therefore one of the main objects of this invention to minimize machining and expense in carbon anode manufacture, to facilitate dissolution of alumina fines and increase cell life, and to reduce anode gas bubble voltage causing less energy consumption. The term "bubble" as used herein is defined to mean and include any gas entrapment, whatever its shape. Initially small discrete round or oval bubbles do form; but they rapidly coalesce to form a flattened sheet-like configuration until released. Then new discrete round or oval bubbles start to form again on the anode surface.

SUMMARY OF THE INVENTION

The above needs are met and object accomplished by providing a plurality of carbon anodes, each having top, bottom and side surfaces, operating in molten electrolyte in an aluminum electrolysis cell, where gas bubbles are generated at the anode surfaces and where alumina particles are added to the top of the molten electrolyte, some of which float on the top of the molten electrolyte and are slow to dissolve, wherein at least one of the carbon anodes has at least one, and preferably two, non-continuous inward slots passing through part of the anode bottom surface along the longitudinal axis of the carbon anode and also passing through only one side surface of the anode, where the height of the slots is from about 45% to 80% of the anode thickness and the slotted side surfaces are disposed toward the center of the electrolysis cell so that generated gas bubbles are directed toward the alumina particles. Preferably the slots will be 9 mm to 12 mm wide and the molten electrolyte will be cryolite based on $Na_3AlF_6$. The term "alumina" is used in a generic sense and includes its hydrous forms such as bauxite, as well as the anhydrous form.

The non-continuous slot(s) are formed in the carbon anodes in such a manner as to direct flow of bubbles and coalesced bubbles generated on the anode surfaces into the slot(s) to facilitate the gas bubbles rapidly moving to the centerline of the reduction cell to expedite the dissolution of alumina, including alumina fines that typically float on top of the bath and are slow to dissolve. Facilitating the gas flow toward the center of the reduction cell keeps the metal to bath interface more stable increasing efficiencies, and results in less erosion to the reduction cell sidewall, thus increasing cell life. In a "Pot," current flow is from the anode, through the low resistant liquid bath to the cathode. If a lot of gas bubbles are generated in the bath which bubbles cannot carry current, you are adding resistance to current flow through the bath, increased "Pot" voltage, and increased "Pot" noise. With slotted anodes the gas bubbles go into the slot(s) and vent in the center of the "Pot" between the anodes, which increases mixing in the alumina feeder area. Use of one or more slots keep the gas bubbles out of the bath that carries current from the anode to the cathode, reducing resistance to current flow, and reducing pot voltage, and pot noise.

BRIEF DESCRIPTION OF THE DRAWINGS

A full understanding of the invention can be appreciated from the following Detailed Description of the Invention when read with reference to the accompanying drawings wherein.

DETAILED DESCRIPTION OF THE INVENTION

Figure 1:
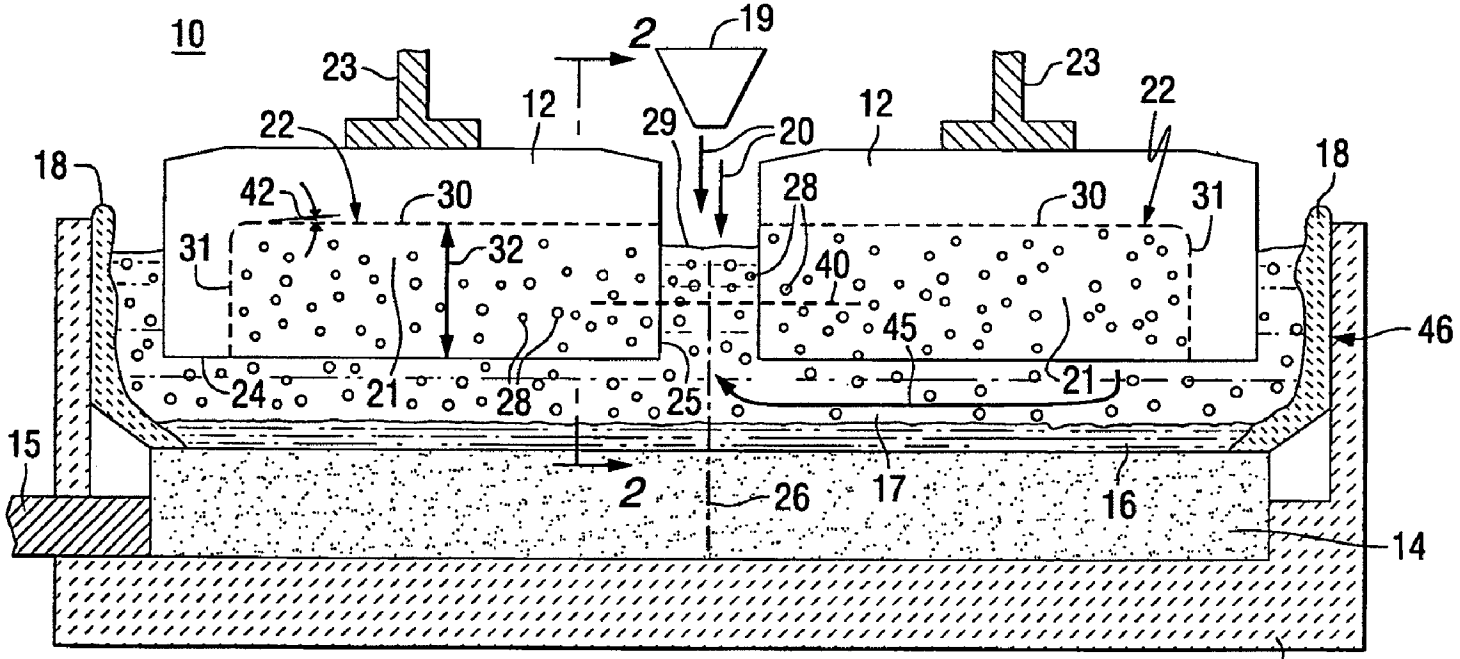
FIG. 1, which best illustrates the invention, is a schematic representation of an aluminum electrolysis cell showing two of the carbon anodes of this invention, where the dotted lines show interior slots in the anode and, for the sake of simplicity, the circles show round gas bubbles inside and outside of the slots.

Referring now to FIG. 1 an aluminum production/electrolysis cell 10 "Pot", including consumable graphite or carbon anodes 12 is shown. The cell 10 includes a refractory material 13 supported by a steel shell (not shown). A cathode 14 made of carbon or the like is located on the refractory material 13. A current collector 15 is connected to the cathode 14. During operation of the cell 10, molten aluminum 16 forms on the surface of the cathode 14. The consumable carbon anodes 12 are immersed in an electrolytic bath 17. A frozen crust 18 of bath material typically forms around the sides of the cell 10. Port 19 provides an inlet for feeding alumina. The alumina is shown by arrows 20. Interior anode end closed slots 21 are defined by dotted lines 22 having a top/roof portion 30 and a back wall end closed portion 31 and also a height 32 dimension. The roof portion 30 can be parallel to the longitudinal axis 40 or at a slight upward angle shown as 42 of about 1° to about 5°. The supports 23 for the anodes 12 are also shown as well as the longitudinal axis 40 of the anodes.

Figure 2:
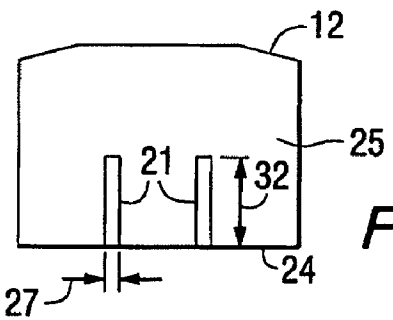
FIG. 2 is a cross sectional view along the axis 2-2 of FIG. 1 of one of the anodes shown in FIG. 1, showing slots in one side of the anode, the opposite side being solid.

Each anode has top bottom and side surfaces where one or more inward slots 21 pass through the anode bottom surface 24 and through only one side surface, herein called the front surface or slotted side surface 25. The slotted side surface faces are disposed toward the center 26 of the electrolysis cell. FIG. 2 shows the slotted side surface 25 and two end closed slots 21 having a width 27. Gas bubbles 28 which are generated on the anode surfaces including within the slots are shown inside and outside the slots are shown as small circles, for the sake of simplicity. As shown the gas bubbles generated on the anode surfaces are directed into the slot(s) and are concentrated by the slot(s) at the point of entry 29 of the alumina particles shown by arrows 20. As described earlier, the gas bubbles will coalesce into a variety of larger shapes before releasing from the anode. Also shown are electrolyte flow/currents 45, shown for the sake of simplicity by one arrow in electrolyte 17. Bubbling toward the center 26 of the cell causes electrolyte flow 45 to follow toward the center, rather than to the sides 46 of the refractory, resulting in less side erosion in the cell.

The horizontal orientation of a standard anode causes gas bubble accumulation beneath the surface. This reduces the availability of the electrically conducting area, which increases the effective resistivity of the electrolyte with the resulting increase in cell resistance referred to as "bubble resistance." It has been discovered that at least one, and preferably two, end closed slots having a slot height from 45% to 80%, preferably from 60% to 75% of the anode thickness and a slot width 27 of from about 9 mm to about 16 mm, preferably 9 mm to 12 mm provide a decrease in bubble resistance and good gas release through the slotted side surface 25 of the anode to provide velocity upward to create turbulence when the gas contacts alumina at point 29, to help prevent alumina agglomeration and/or alumina floating on the surface of the bath electrolyte 17 and to reduce anode gas bubble voltage thereby saving cell voltage.

EXAMPLE

Experimental carbon anodes were produced with two 12 mm wide slots, each slot having a slot height from 45% to 80% of the anode thickness, with a flat roof portion, and a closed end. The front profile was similar to FIG. 2, where the slots were located near and on opposite sides of center, rather than at the near the sides.

From 16 to 32 anodes, two in a row, were placed in a pilot aluminum electrolysis cell, contacting molten cryolite at about 950° C. and operated with the slotted side surface facing the center of the cell, as shown in FIG. 1 with a pot voltage of about 402 volts to 4.7 volts. The use of the dual end closed slots generated substantial upward velocity of the various sized and shaped bubbles and was very helpful in breakup of alumina feed agglomerates and also lowered cell voltage by reducing anode gas bubble voltage.

Figure 3:
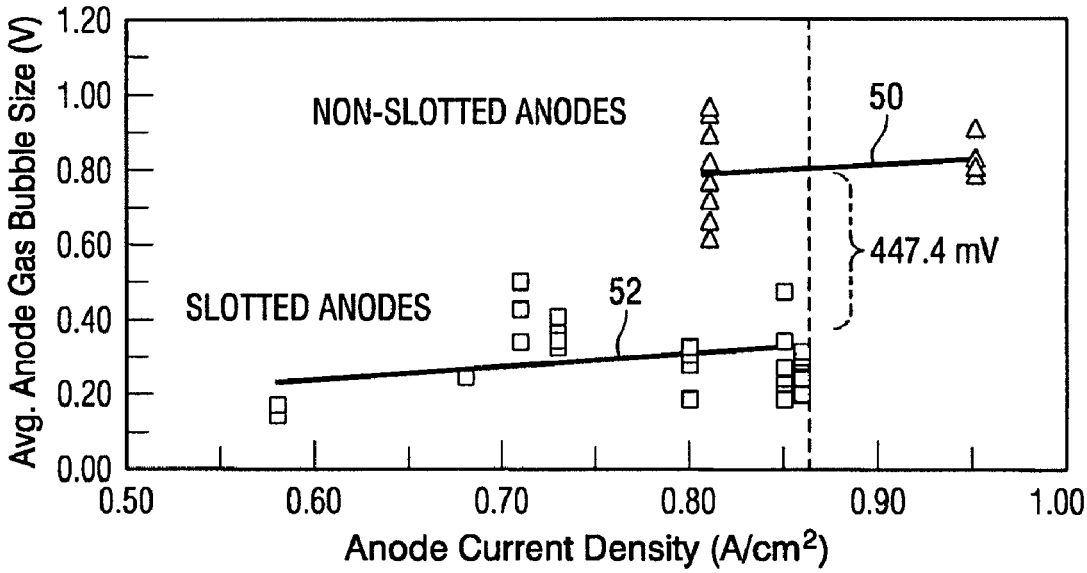
FIG. 3 is a comparative graph showing reduction in bubble size (as an average magnitude of voltage oscillation) vs. anode current density, for slotted anodes (plot line 52)

The presence of slots substantially reduced the magnitude of the anode voltage oscillation/fluctuation. FIG. 3 summarizes the magnitude of the anode gas bubble induced anode voltage fluctuation for both standard anodes plot line 50 and slotted anodes plot line 52 as a function of anode current density. Anode current density slightly increased the magnitude of the anode gas bubble size or anode voltage fluctuation for both regular non-slotted anodes and slotted anodes. For the slotted anode, it increased on an average from 0.2 to 0.4V when apparent anode current density increased from 0.58 to 0.85 A/cm$^2$. A difference of 447.4 mV was seen in the magnitude of the anode gas bubble fluctuation between regular non-slotted anode and slotted anode at an apparent current density of 0.86 A/cm$^2$.

Figure 4:
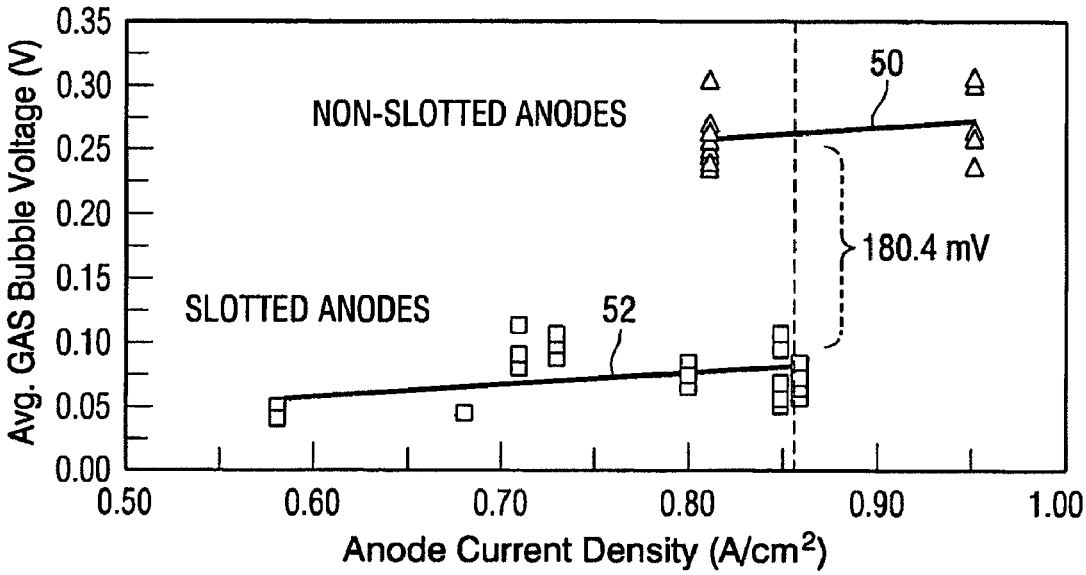
FIG. 4 is a comparative graph showing reduction in anode gas bubble voltage vs. anode current density, for slotted anodes (plot line 52).

The presence of slots also substantially reduces the anode gas bubble voltage drop, as shown in FIG. 4. At an apparent current density of 0.86 A/cm$^2$, the anode gas bubble voltage drop was measured to be 263.7 mV and 83.3 mV, respectively for regular non-slotted anode and slotted anode. The two slots produced a saving of 180.4 mV in the anode gas bubble voltage drop on a single anode.

Having described the presently preferred embodiments, it is to be understood that the invention may be otherwise embodied with the scope of the appended claims.

What is claimed is:

1. A carbon anode for use in a metal electrolysis cell, the carbon anode comprising:

a carbon block comprising:

a top portion adapted to interconnect to overhead supports of an aluminum electrolysis cell a bottom portion adapted for submersion in an electrolyte bath of an aluminum electrolysis cell; and at least one non-continuous slot passing through one side portion of the carbon block, wherein the at least one non-continuous slot passes through a part of the bottom portion of the carbon block, and wherein the at least one non-continuous slot is adapted to direct gases evolved during operation of a metal electrolysis cell toward a centerline of the metal electrolysis cell.

2. The carbon anode of claim 1, wherein the at least one non-continuous slot has a height of from about 45% to 80% of the thickness of the carbon block.

3. The carbon anode of claim 1, wherein the at least one non-continuous slot has a height of from about 60% to 75% of the thickness of the carbon block.

4. The carbon anode of claim 1, wherein the at least one non-continuous slot has a width of from about 9 mm to about 16 mm.

5. The carbon anode of claim 1, wherein the at least one non-continuous slot has a width of from about 9 mm to about 12 mm.

6. The carbon anode of claim 1, wherein the at least one non-continuous slot has a length that extends a majority of the length of the bottom portion of the carbon block.

7. The carbon anode of claim 6, wherein the at least one non-continuous slot has a length that extends less than the full length of the bottom portion of the carbon block.

8. The carbon anode of claim 1, wherein the at least one non-continuous slot comprises a roof portion, wherein the roof portion is parallel to the longitudinal axis of the carbon anode.

9. The carbon anode of claim 1, wherein the at least one non-continuous slot comprises a roof portion, wherein the roof is angled relative to the longitudinal axis of the carbon anode.

10. The carbon anode of claim 9, wherein the roof is angled from 1° to 5° relative to the longitudinal axis of the carbon anode.

11. The carbon anode of claim 1, wherein three side portions of the carbon block are free of non-continuous slots.

12. An electrolysis cell comprising a plurality of the carbon anodes of claim 1.

* * * * *